2/10/87 XR 4,641,679

United States Patent [19]

Arnaudeau et al.

[11] Patent Number: 4,641,679

[45] Date of Patent: Feb. 10, 1987

[54] FEED DEVICE FOR A TWO-PHASE FLUID PUMP AND A HYDROCARBON PRODUCING INSTALLATION WITH SUCH FEED DEVICE

[75] Inventors: Marcel Arnaudeau; Philippe Rousset, both of Paris, France

[73] Assignee: Institute Francais du Petrole, Rueil Malmaison, France

[21] Appl. No.: 774,602

[22] PCT Filed: Dec. 31, 1984

[86] PCT No.: PCT/FR84/00304

§ 371 Date: Aug. 30, 1985

§ 102(e) Date: Aug. 30, 1985

[30] Foreign Application Priority Data

Dec. 30, 1983 [FR] France ..... 83 21089

[51] Int. Cl.[4] ..... F04D 31/00

[52] U.S. Cl. ..... 137/88; 137/13; 137/110; 137/154; 137/890

[58] Field of Search ..... 137/3, 13, 88, 110, 137/154, 890

[56] References Cited

U.S. PATENT DOCUMENTS 4,310,335 1/1982 Arnaudeau ..... 137/13 X 4,325,712 4/1982 Arnaudeau ..... 137/13 X

*Primary Examiner*—Robert G. Nilson

*Attorney, Agent, or Firm*—Brisebois & Kruger

[57] ABSTRACT

A feed device for a two-phase fluid pump enabling the pump to be supplied with a two-phase fluid having characteristics, especially the volumetric ratio of the gaseous phase to the liquid phase, compatible with the operating characteristics of the pump. The device has a main pipe (10*a*) and a plurality of auxiliary pipes (10*b*, . . . 10*i*) parallel to the main pipe. Each of the pipes can be connected to an upstream supply line of two-phase fluid, and to the downstream pump (6), each of the pipes having an isolation and flow regulating gate (11*a*, . . . 11*i*) at its upstream inlet and an isolation and flow regulating gate (12*a*, . . . 12*i*) at its downstream outlet, each of the pipes also having means (16*a*, . . . 16*i*; 17*a*; 17*i*) for introducing a carrier liquid, such as water.

10 Claims, 2 Drawing Figures

Figure 1:
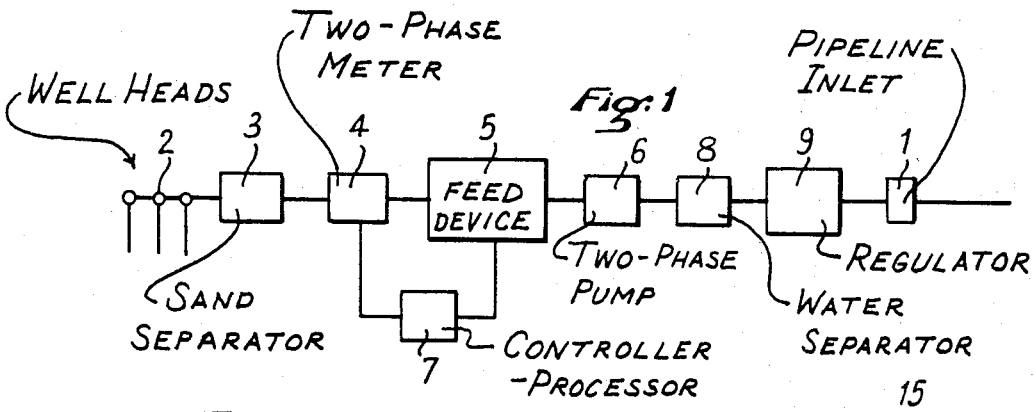

WELL HEADS
TWO-PHASE METER
PIPELINE INLET
FEED DEVICE
SAND SEPARATOR
TWO-PHASE PUMP
REGULATOR
WATER SEPARATOR
CONTROLLER -PROCESSOR
1
2
3
4
5
6
7
8
9

4
5
6
7
15
10a
10b
10c
10i
11a
11b
11c
11i
12a
12b
12c
12i
13a
13b
13c
13i
14a
14b
14c
14i
16a
16b
16c
16i
17a
17b
17c
17i

FEED DEVICE FOR A TWO-PHASE FLUID PUMP AND A HYDROCARBON PRODUCING INSTALLATION WITH SUCH FEED DEVICE

This invention concerns a feed device for a two-phase fluid pump.

It is known that such pumps, known for example from French patent application No. 79 31031, are used for pumping a two-phase fluid, i.e. a mixture comprising a liquid phase and a gaseous phase not dissolved in the liquid. For correct operation, the fluid supplied to the pump must be homogenous and at stable pressure and must, moreover, have a feed and volumetric ratio of the gaseous phase to the liquid phase for given thermodynamic conditions within the specified limits.

In particular pumps intended to ensure the compression of two-phase fluids only accept mixtures having a volumetric ratio of the gaseous phase to the liquid phase less than a maximum value and only tolerate bubbles of gas, i.e. masses of fluid only occuring in gaseous form, in their feed pipe if their volume is also lower than a maximum value.

This invention aims to provide a feed device for a two-phase fluid pump enabling the supply to the pump of a two-phase fluid having characteristics, especially those regarding feed and the volumetric ratio of the gaseous phase to the liquid phase, compatible with the operating characteristics of the pump.

For this purpose the scope of the invention is such a feed device, characterised in that it comprises a main pipe and a plurality of auxiliary pipes arranged parallel to the main pipe, each of the pipes capable of being connected upstream to a supply line of two-phase fluid and downstream to the pump, each of the pipes having an isolation and flow control gate at its entrance end and an isolation and flow control gate at its exit end, each of the pipes also having means for introducing a carrier liquid, in particular water.

Thus, when the volumetric ratio becomes greater than the maximum permissible ratio, carrier fluid may be introduced into the main pipe so as to bring about a reduction in this volumetric ratio.

Similarly, if a gas bubble with a volume too great to be absorbed by the pump appears at the entrance to the feed device, this gas bubble may be directed towards auxiliary pipes where it is stored until the supply becomes normal again. Carrier fluid can then be introduced into these auxiliary pipes so as to form there a two-phase fluid having suitable characteristics which can then be directed toward the pump.

In a preferred embodiment, each of the pipes has at least one flow homogenising mechanism, preferably of the converging/diverging type.

Advantageously, each of the pipes has one homogenising mechanism downstream from each entry gate and one homogenising mechanism upstream from each exit gate.

When the flow is operating normally the gates of the auxiliary pipes can be closed, these pipes then being filled with a carrier liquid, in particular water.

The main pipes and auxiliary pipes can be rigid or flexible.

The device according to the invention is preferably controlled so that the gates of auxiliary pipes are selectively opened as a function of feed values and values of the volumetric ratio of the gaseous phase to the liquid phase determined by a measuring mechanism in the supply line for two-phase fluid upstream from the said device.

In a particular embodiment of the invention the device comprises a recycling circuit for the two-phase fluid between the delivery side of the pump on the one hand and the main pipe and/or the supply line upstream from the device on the other hand.

In this case, the carrier fluid introduced into the device, or at least a part of this fluid, is consequently taken downstream from the pump.

The scope of this invention is also a hydrocarbon producing installation, characterised in that it comprises an external two-phase pump such as, for example, that described in French patent application No. 79 31031, fitted with a feed device as described above, the two-phase fluid then being a two-phase oil effluent composed of a mixture of oil and gas.

Figure 2:
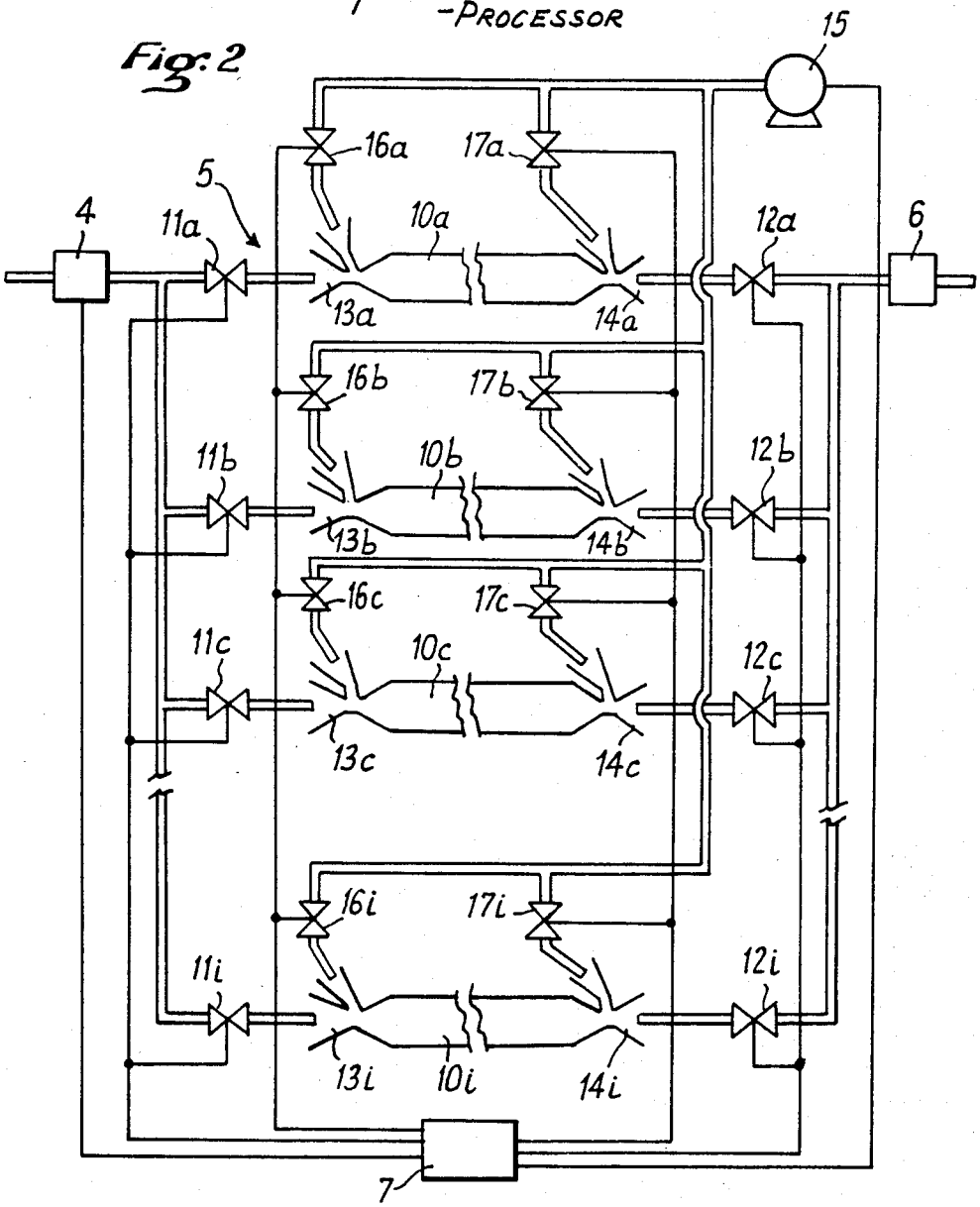

A specific embodiment of the invention will now be described as a non-restrictive example with reference to the attached drawings in which:

FIG. 1 is a general diagram of a hydrocarbon producing installation according to the invention, and FIG. 2 represents in more detail, but nevertheless as a diagram, the feed device according to the invention of this installation.

The installation represented in FIG. 1 enables the injection at the entrance 1 of a pipeline a two-phase hydrocarbon mixture collected at the shaft heads or well 2.

This installation comprises firstly a sand separator 3, then a two-phase meter 4 which enables the volumetric feed of the liquid and gaseous phases of the mixture to be known, and consequently the volumetric ratio of the gaseous phase to the liquid phase.

A feed device 5 for an external two-phase pump 6 is provided downstream from the meter 4 and is controlled by a processing unit 7 from information received from this meter.

The pump 6 is followed by a water separator 8 and possibly by a regulator 9 enabling the supply to the pipeline of a two-phase mixture having homogenous characteristics.

Meter 4 is a meter for measuring the liquid and gaseous phases of a two-phase flowing through the meter to the feed device 5. Meter 4 can be of the type disclosed in U.S. application Ser. No. 774,603 filed Aug. 30, 1985, and the disclosure of which is incorporated by reference. As disclosed in that application, the meter has a tubular enclosure rotated by a motor to separate the fluid into an outer annular wall or layer of liquid surrounding an inner tubular region or layer of gas, as the fluid flows through the meter. The volumetric ratio of gas to liquid is determined by measuring the thickness and velocity of the inner and outer layers, and comparing the measurements with predetermined model or empirical values of volumetric ratio, which can be values stored in a memory of the meter or processor unit 7. Such measurements are made at a defined frequency so that the volumetric ratio data in the processor unit is continually updated.

The feed device 5 (FIG. 2) comprises in accordance with the invention a main pipe 10*a* and auxiliary pipes 10*b*, 10*c*, . . . 10*i*. Pipes 10*a* to 10*i* are connected in parallel between the exit of the meter 4 and the entrance of the external two-phase pump 6.

Isolation and flow-regulating gates or valves 11*a*, . . . 11*i* are provided upstream from each of the pipes 10*a*, . . . 10*i*, and other isolation and flow-regulating gates 12*a*, . . . 12*i* are provided downstream from each of these pipes.

Downstream from each of gates 11*a*, . . . 11*i*, a homogenising mechanism 13*a*, . . . 13*i* is placed at the entry to each pipe 10*a*, . . . 10*i*.

This mechanism is for example of the type described in French patent application No. 82 17245. Similar homogenising mechanisms 14*a*, . . . 14*i* are placed at the exit to each of the pipes 10*a*, . . . 10*i* upstream from gates or valves 12*a*, . . . 12*i*.

Homogenisers 13*a*, . . . 13*i*, 14*a*, . . . 14*i*, are fed by carrier fluid, such as water, for example by a pump 15, by means of gates or valves 16*a*, . . . 16*i*, 17*a*, . . . 17*i* respectively.

The processing unit 7 receives its information from the feedmeter 4 and ensures the control of the pump 15 and gates 11*a*, . . . 11*i*, 12*a*, . . . 12*i*. 16*a*, . . . 16*i*, 17*a*, . . . 17*i*.

The device 5 operates in the following way.

As long as the meter records a volumetric ratio of the gaseous phase to the liquid phase lower than the value acceptable by the two-phase pump 6, recorded in the memory of the processing unit 7, the flow is carried out directly from the meter 4 to the two-phase pump 6 through the pipe 10*a*, gates 11*a* and 12*a* being open and all the other gates of the device being closed. In this configuration or state of the gates all the other pipes 10*b*, 10*c*, . . . 10*i* are full of water.

When the meter 4 records a volumetric ratio greater than the limit value acceptable by the two-phase pump 6 but for a time so that the volume of the gas bubble resulting therefrom is less than the maximum permissible volume, the flow continues only through the pipe 10*a* but homogenisers 13*a* and 14*a* are brought into operation by the processing unit 7 by opening the gates 16*a* and 17*a*, thus introducing carrier liquid with an adjusted feed so as to restore the volumetric ratio at the entrance of the two-phase pump 6 to a value lower than the maximum permissible value. This carrier liquid may, for example, be water supplied by the pump 15 and if necessary two-phase fluid recycled from the output of the two-phase pump 6. This recycling circuit is not shown on the drawing. If the volumetric ratio then drops to an acceptable value, the system returns to its normal operating position described above, in which the gates 16*a* and 17*a* are closed.

If, on the other hand, the meter 4 records a volumetric ratio greater than the limit value for a period of time so that the volume of the gas bubble exceeds the maximum permissible value, the device 5 then allows this gas bubble to be absorbed only to restore it later.

In these conditions the unit 7 causes the opening of gates 11*b* and 12*b* so that the gas bubble is directed towards pipe 10*b*. It expels the water the pipe 10*b* contains which is consequently evacuated and absorbed by the two-phase pump 6 at the same time as the regulated two-phase mixture coming out of the pipe 10*a* as before. Thus the two-phase pump 6 absorbs a two-phase mixture having a volumetric ratio less than the maximum permissible value although the two-phase feed ratio has increased.

If the gas bubble has a too great volume to be entirely absorbed in the pipe 10*b*, unit 7 causes the closure of gates 11*b* and 12*b* and the opening of gates 11*c* and 12*c* and the same process can be repeated until the pipe 10*i* is full.

If the gas bubble is entirely absorbed and the volumetric ratio again becomes less than the maximum permissible value, the operation of refilling pipes 10*b*, 10*c*, . . . 10*i* may begin under the action of the pump 15.

For this the homogenisers 13 and 14 of each pipe 10 are successively put into operation by opening corresponding gates 16 and 17, the homogeniser 13 allowing the pipe 10 to be supplied with water which expels the gas it contains, this gas receiving water from the homogeniser 14 before being directed in the form of a two-phase mixture towards the pump 6 at the same time as the normal flow crossing the pipe 10*a*.

Pipes 10*b*, 10*c*, . . . 10*i* are thus successively emptied of gas and filled with carrier liquid.

It is understood that the gas absorption capacity of the feed device is determined by the volume of pipes 10*b*, . . . 10*i* which it comprises, the dimensions of the pipes being determined in accordance with the conditions of use, the pipes capable of having the same volume or preferably different volumes.

Of course the invention is not limited to the embodiment described above to which various amendments and modifications may be made without departing from the scope or the spirit of the invention.

We claim:

1. A feed device for a two-phase liquid pump for supplying to the inlet of the pump a two-phase fluid having a volumetric ratio of gaseous phase to liquid phase compatible with the operating characteristics of the pump, said device comprising, a main pipe having an inlet adapted to be connected to a source of two-phase fluid and an outlet adapted to be connected to the inlet of the pump, a plurality of auxiliary pipes connected in parallel to said main pipe, each of said auxilliary pipes having an inlet adapted to be connected to the source of two phase fluid and an outlet adapted to be connected to the inlet of the pump, each of said pipes having an isolating and flow regulating gate between the outlet thereof and the inlet of the pump, and means for introducing a carrier liquid into each of said pipes.

2. Device according to claim 1 wherein, each of the pipes has at least one converging-diverging flow homogenising mechanism.

3. Device according to claim 1 wherein each of the pipes has a homogenising mechanism downstream from each inlet and a homogenising mechanism upstream from each outlet.

4. Device according to claim 1 wherein, during flow of a two-phase fluid to the device which is compatible with the operation characteristics of the pump, said gates of the auxiliary pipes are closed, said auxiliary pipes are filled with a carrier liquid, and the gate of the main pipe is open, so that substantially all flow of the two-phase fluid is from the source to the inlet of the pump is through said main pipe.

5. Device according to claim 1, wherein said pipes comprise rigid rigid pipes.

6. Device according to claim 1, wherein said pipes comprise flexible pipes.

7. Device according to claim 1, comprising measuring means upstream of the device for measuring the volumetric ratio of the gaseous phase to the liquid phase of the two-phase fluid flowing to the device, and means for selectively opening the gates of the auxiliary pipes as a function of the measured volumetric ratio.

8. Device according to claim 1, comprising a recycling circuit for the two-phase fluid from the outlet side of the pump to the main pipe.

9. Device according to claim 1, comprising a recycling circuit for the two-phase fluid from the outlet side of the pump to the source.

10. Hydrocarbon producing installation comprising a two-phase fluid pump, and a feed device as claimed in claim 1 connected to the inlet of the pump.

* * * * *